US005911534A

United States Patent [19]

Toyama

[11] Patent Number: 5,911,534

[45] Date of Patent: Jun. 15, 1999

[54] CAP FOR WRITING TOOL

[75] Inventor: Matsuhei Toyama, Tokyo, Japan

[73] Assignee: Zebra Co., Ltd., Tokyo, Japan

[21] Appl. No.: 08/751,716

[22] Filed: Nov. 18, 1996

Related U.S. Application Data

[63] Continuation of application No. 08/369,008, Jan. 5, 1995, abandoned.

[30] Foreign Application Priority Data

Oct. 3, 1994 [JP] Japan ..... 6-238856

[51] Int. Cl.[6] ..... B43K 23/08; B43K 23/12

[52] U.S. Cl. ..... 401/213; 401/6; 401/202; 401/243

[58] Field of Search ..... 401/6, 202, 213, 401/243

[56] References Cited

U.S. PATENT DOCUMENTS

| | | |
|---|---|---|
| 2,312,069 | 2/1943 | Baumgartner . |
| 3,941,491 | 3/1976 | Mutschler . |
| 4,123,179 | 10/1978 | Pacheco . |
| 4,355,726 | 10/1982 | Mutschler . |
| 5,154,526 | 10/1992 | Bothe . |

FOREIGN PATENT DOCUMENTS

| | | |
|---|---|---|
| 1193771 | 11/1959 | France . |
| 2265552 | 10/1975 | France . |
| 2622512 | 5/1989 | France . |
| 1253614 | 11/1967 | Germany . |
| 2013582 | 10/1971 | Germany . |
| 2157175 | 5/1973 | Germany . |
| 8714810 | 2/1988 | Germany . |
| 3644978 | 6/1988 | Germany ..... 401/213 |
| 782159 | 7/1955 | United Kingdom . |
| WO 80/00557 | 4/1980 | WIPO . |
| WO 93/09961 | 5/1993 | WIPO . |

OTHER PUBLICATIONS

Petrillo, R.J. (1992) US Statutory Invention Registration H 1050.

*Primary Examiner*—Steven A. Bratlie
*Attorney, Agent, or Firm*—Klauber & Jackson

[57] ABSTRACT

A cap, for a writing tool having on the outside of a cylindrical shell an elastic member made of a material different from that of the cap, including a plurality of longitudinal ribs formed on the inner peripheral surface of the cap in such a manner as to extend along the longitudinal direction of the cylindrical shell. The end portions of the plurality of the longitudinal ribs on the opening edge side of the cap are each formed in the shape of an arch.

8 Claims, 2 Drawing Sheets

CAP FOR WRITING TOOL

This application is a Continuation of application Ser. No. 08/369,008, filed Jan. 5, 1995 now abandoned.

FIELD OF THE INVENTION

The present invention relates to a cap to be fitted onto a pen point side of a writing tool such as ball-point pen or a signing pen. In particular, the invention concerns an improvement of a, cap to be fitted onto a writing tool of a type in which a so-called non-slip means formed of an elastic member, being different in material from the cap or a cylindrical shell, is mounted on a grip portion of the cylindrical shell for improving both the non-slip characteristics and the grasp feeling during use of the writing tool.

BACKGROUND OF THE INVENTION

Recently, a writing tool having a non-slip means has been proposed, wherein the non-slip means is mounted on an outer portion (grip portion) of a pen point side of a cylindrical shell for permitting the user of the writing tool to grasp the cylindrical shell firmly without fatigue even when used for a long period of time. However, for attaining the non-slip purpose in use, the non-slip means is mainly formed of a soft elastic material exhibiting a slip preventing effect, such as rubber, while the cap is formed of a hard resin similar to the cylindrical shell. Further, the inner surface (inside diameter) of the cap is formed in a shape to be firmly fitted around the outer surface (outside diameter) of the grip portion of the cylindrical shell.

Consequently, at the time of mounting or pulling off the cap, the cap is brought into direct contact with the non-slip means and a large contact force is applied against the elastic member. Since the mounting and removal of the cap are performed forcibly, the non-slip means is damaged in a short period of time and hence its slip preventing effect is deteriorated.

SUMMARY OF THE INVENTION

An object of the invention is to provide a cap, used with a writing tool provided with an elastic non-slip means, capable of reducing the force of contact between the cap and the outside of a cylindrical shell supporting the elastic non-slip means, thereby lengthening the life of the elastic non-slip means and effecting smooth mounting and removal of the cap.

To achieve the above object, according to the present invention, there is provided a cap, for a writing tool having on the outside of a cylindrical shell an elastic member made of a material different from that of the cap and the cylindrical shell, having a plurality of longitudinal ribs formed on the inner peripheral surface of the cap in such a manner as to extend along in the longitudinal direction of the cylindrical shell. The end portions of the plurality longitudinal ribs, which are located at the opening edge side of the cap, may each be formed in the shape of an arch.

According to the present invention, since the longitudinal ribs are formed on the inner peripheral surface of the cap, the cap is fitted on the cylindrical shell so that there is a state of linear contact between the longitudinal ribs and the elastic member provided on the outside of the cylindrical shell, whereby the contact force is greatly reduced.

PREFERRED EMBODIMENT OF THE INVENTION

Figure 1:
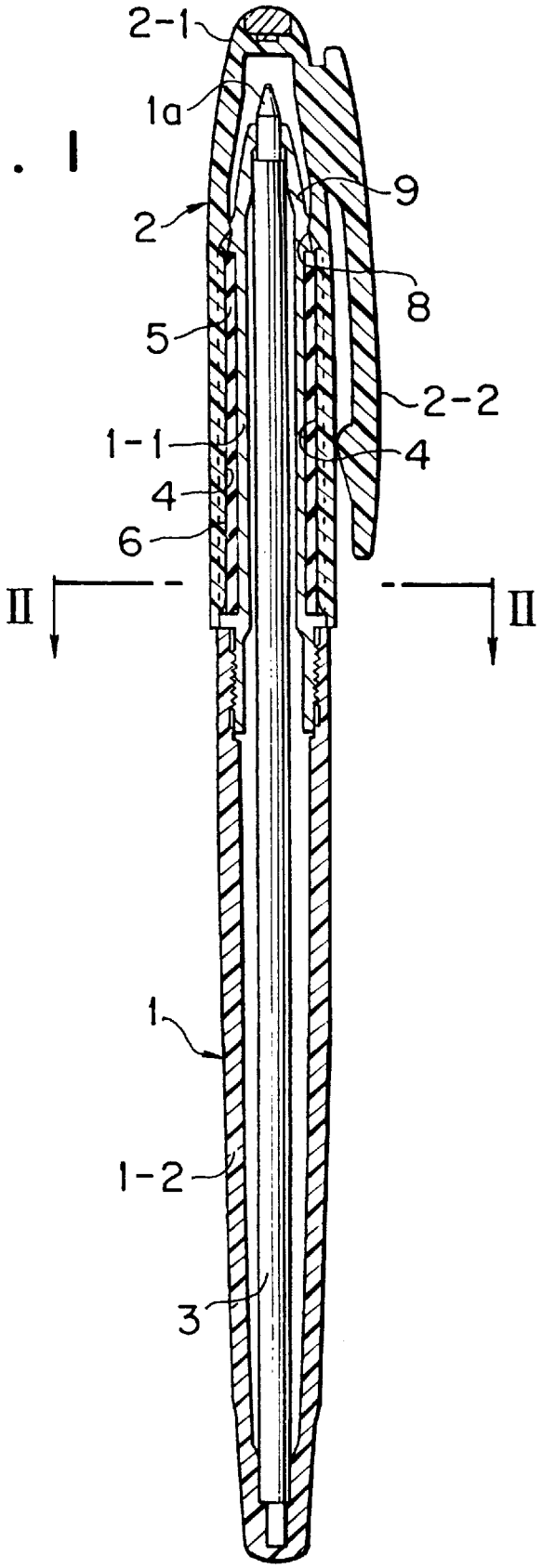
FIG. 1 is a vertical sectional view of a cap as fitted on a cylindrical shell.

An embodiment of the present invention will now be described with reference to the drawings. FIG. 1 illustrates a ball-point pen as an example of writing tool. In the same figure, the numeral 1 denotes a cylindrical shell, numeral 2 denotes a cap which is fitted removably on a pen point 1*a* side of the cylindrical shell 1, and numeral 3 denotes a spare ink tube loaded into the cylindrical shell 1. On the inner peripheral surface of the cap 2 are formed a plurality of longitudinal ribs 4 extending along the cylindrical shell to minimize the force of contact with an elastic member 5 which is mounted on the pen point 1*a* side of the cylindrical shell 1.

Each of the cylindrical shell 1 and the cap 2 may be molded by blow molding or injection molding. The cylindrical shell 1 comprises a cylindrical front portion 1-1 which serves as a grip portion and a cylindrical rear portion 1-2 which is removably screwed onto the rear end of the front portion 1-1. The outside of the cylindrical front portion 1-1 is formed with a recess 6 for mounting of the elastic member 5 in such a manner that the elastic member 5 cannot move along the longitudinal direction of the cylindrical shell. On the outside of the cylindrical shell 1 is formed a ring-like projection 9 at a position between the recess 6 and the pen point so as to be closely engaged with a ring-like projection 8 formed on the inner peripheral surface of the cap 2 as will be described later.

On the other hand, the cap 2 has a cap portion 2-1 and a clip 2-2 formed integrally with the cap portion 2-1. The cap portion 2-1 has length capable of covering the whole of the cylindrical front portion 1-1 including the pen point 1*a*. Moreover, the cap portion 2-1 has an inside diameter that is not in contact with the elastic member 5. On the inner peripheral surface of the cap portion 2-1 are formed a plurality of longitudinal ribs 4 extending along the longitudinal direction of the cylindrical shell, namely, in the direction of insertion and removal of the cap 2, from the portion near the opening edge of the cap. Further, on the inner end side of the longitudinal ribs 4, a ring-like projection 8 is formed on the inner peripheral surface of the cap portion.

The longitudinal ribs 4 function to reduce the area that the cap portion 2-1 is in contact with the elastic member 5 so that the cap portion 2-1 of the cap 2 can be smoothly fitted on and pulled off from the cylindrical front portion 1-1 of the cylindrical shell 1.

Figure 2A:
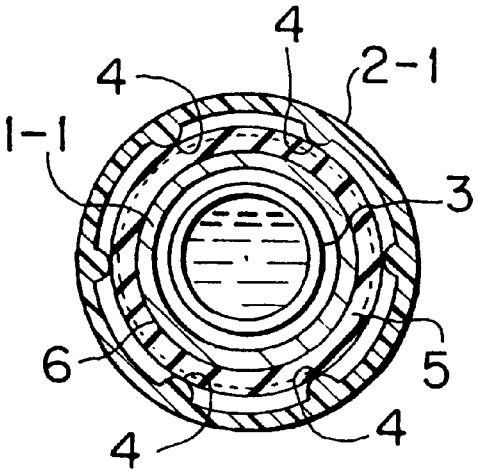
FIGS. 2(*a*) and 2(*b*) are cross-sectional views taken on line II—II in FIG. 1.
Figure 2B:
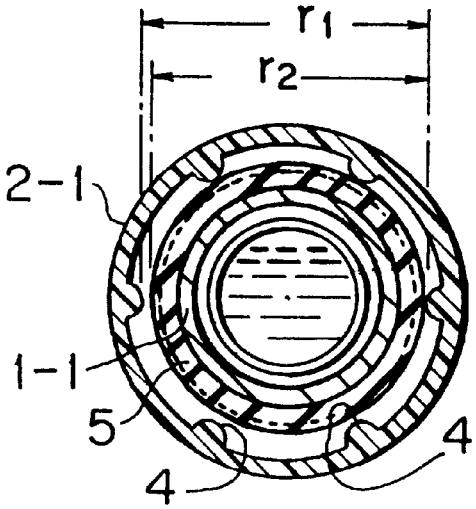
Figure 3:
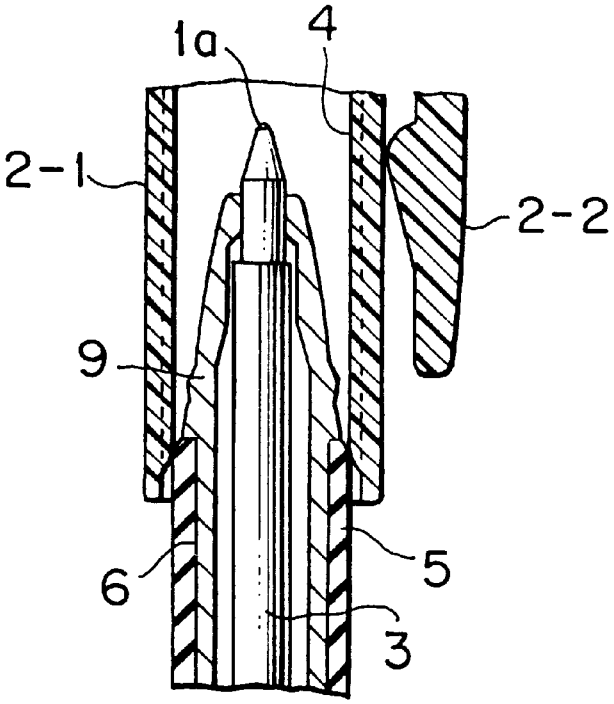
FIG. 3 is an enlarged sectional view of an essential portion of the cap.

The plurality of ribs, which usually range from 3 to 6 (6 in this embodiment), are formed integrally with the cap 2 along the inner surface of the cap portion 2-1 The end portions of the longitudinal ribs 4, which are located at the opening edge side of the cap portion 2-1 of the cap 2, are each formed largely in the shape of an arch, whereby the end portions are prevented from being caught on the elastic member 5 when the cap is fitted on the cylindrical shell 1 (see FIG. 3). As shown in FIG. 2(*b*), a virtual inside diameter r1 connecting the apexes of the longitudinal ribs 4 to each other in the circumferential direction may be larger than the outside diameter r2 of the elastic member 5 (r1>r2).

Thus according to the cap 2 of this embodiment, when the cap is fitted on or pulled off of the cylindrical shell 1, it is brought into linear contact with the elastic member 5 formed of a soft resin, rubber, or the like in the direction of insertion and removal of the cap by way of the longitudinal ribs 4 formed on the inner peripheral surface of the cap portion 2-1.

Consequently, it is possible to reduce the contact area, that is, reduce the contact force greatly, whereby the mounting and removal of the cap can be performed smoothly.

Although in the above embodiment the elastic member 5 is provided on the pen point 1*a* side outside the cylindrical shell 1 there may be adopted a rudder shaft with the elastic member 5 provided not only on the pen point 1*a* side but also over the whole of the outside of the cylindrical shell 1.

Having described specific preferred embodiments of the invention with reference to the accompanying drawings, it will be appreciated that the present invention is not limited to those precise embodiments and that various changes and modification can be effected therein by one of ordinary skill in the art without departing from the scope and spirit of the invention as defined by the appended claims.

What is claimed is:

1. A writing tool comprising:

a cylindrical shell having a pen point side and a grippable portion which is gripped by the user of said tool for writing therewith;

a cap which is removably fitted on said pen point side of said cylindrical shell, said cap having a plurality of longitudinal ribs disposed on its inner peripheral surface, wherein said cap is made from a hard resin; and an elastic member, having a uniform lengthwise diameter, wherein said elastic member is disposed on said grippable portion, and wherein said elastic member is capable of contacting said ribs when said cap is mounted or removed, thereby reducing the contact area and hence the contact force between said cap and said elastic member.

2. A writing tool according to claim 1, wherein each of said ribs further comprises an end portion disposed at the open side of said cap, wherein said end portion is cut in the form of an arch.

3. A writing tool according to claim 2, wherein said cap further comprises a ring like projection disposed on the inner end side of said longitudinal ribs, wherein said cylindrical shell further comprises a ring like projection which closely engages said ring like projection on said cap.

4. A writing tool according to claim 3, wherein a virtual diameter connecting the apexes of said ribs is larger than the outside diameter of said elastic member.

5. A writing tool according to claim 2, wherein a virtual diameter connecting the apexes of said ribs is larger than the outside diameter of said elastic member.

6. A writing tool according to claim 1, wherein said cap further comprises a ring like projection disposed on the inner end side of said longitudinal ribs, wherein said cylindrical shell further comprises a ring like projection which closely engages said ring like projection on said cap.

7. A writing tool according to claim 6, wherein a virtual diameter connecting the apexes of said ribs is larger than the outside diameter of said elastic member.

8. A writing tool according to claim 1, wherein a virtual diameter connecting the apexes of said ribs is larger than the outside diameter of said elastic member.

* * * * *